United States Patent [19]

Damrau et al.

[11] Patent Number: 4,512,279

[45] Date of Patent: Apr. 23, 1985

[54] PAPER COATING APPARATUS

[75] Inventors: Wayne A. Damrau; James C. Gauss, both of Wisconsin Rapids, Wis.

[73] Assignee: Consolidated Papers, Inc., Wisconsin Rapids, Wis.

[21] Appl. No.: 501,969

[22] Filed: Jun. 10, 1983

Related U.S. Application Data

[63] Continuation of Ser. No. 863,464, Dec. 22, 1977, , which is a continuation-in-part of Ser. No. 683,669, May 6, 1976, abandoned.

[51] Int. Cl.[3] ..... B05C 5/02

[52] U.S. Cl. ..... 118/411; 118/413

[58] Field of Search ..... 118/407, 410, 411, 412, 118/413, 261, 7, 206; 427/356, 358

[56] References Cited

U.S. PATENT DOCUMENTS

| | | | |
|---|---|---|---|
| 2,328,183 | 8/1943 | Barrett | 118/413 |
| 2,399,688 | 5/1946 | Metzner et al. | 118/7 X |
| 2,796,846 | 6/1957 | Trist | 118/413 X |
| 2,918,899 | 12/1959 | Munton et al. | 118/413 |
| 3,032,007 | 5/1962 | McCauliff | 118/407 |
| 3,070,066 | 12/1962 | Faeber | 118/413 |
| 3,078,825 | 2/1963 | Munton et al. | 118/413 |
| 3,079,889 | 3/1963 | Jacobs et al. | 118/413 X |
| 3,202,536 | 8/1965 | Brezinski | 118/206 X |
| 3,273,535 | 9/1966 | Krikorian | 118/410 |
| 3,301,214 | 1/1967 | Coghill | 118/413 X |
| 3,348,526 | 10/1967 | Neubauer | 118/410 |
| 3,418,970 | 12/1968 | Phelps et al. | 118/410 |
| 3,453,137 | 7/1969 | Penkala et al. | 118/413 X |
| 3,484,279 | 12/1969 | Clark et al. | 118/7 X |
| 3,486,482 | 12/1969 | Hunger | 118/413 X |
| 3,930,464 | 1/1976 | Wallsten | 118/411 X |

*Primary Examiner*—John P. McIntosh
*Attorney, Agent, or Firm*—Gary, Juettner & Pyle

[57] ABSTRACT

A method and apparatus for applying a film of liquid pigmented coating material to a moving web of paper at, and between, a low limit of two pounds per ream and a high limit of fifteen pounds per ream. The method and apparatus utilize a reservoir of liquid coating material established between a forward liquid coating material seal and a rearward pneumatically loaded and clamped doctor blade spaced a small distance of a few inches or less from the liquid seal. The reservoir is pressurized in the range of 7 to 150 inches of water so that the coating material is applied under pressure to the moving web and then almost instantaneously wiped by the doctor blade. The reservoir is formed by two relatively movable, sealed members which may be opened for easy cleaning, and may have one or more internal coating material distribution headers at its end opposite the web to uniformly distribute the coating material. A reliable, duplicable adjustment for a movable element forming the front edge of the reservoir is provided to establish and control the liquid seal. End dams are located at the ends of the reservoir between the doctor blade and cut-away portions of the movable element to control undesired outflow of coating material. Further, a pair of such applicators may be arranged on opposite sides of the web to simultaneously coat both sides of the web. In addition, the method and apparatus have other features providing easy adjustment, operation, clean-up, high, low or medium weight coatings better than any single prior device and method, and better lightweight coatings than prior devices and methods.

2 Claims, 15 Drawing Figures

24
27
26
3.
50
63
3.
20
70
65
60
62
61
66
29
28
64
68
48
32
52
34
54
44
30
46
36
38
22

24
48
50
63
61
67
65
32

4.
24
27
26
50
112
5.
65
63
20
28
60
70
62
66
68
5.
88
29
56
4.
48
58
40
32
42
34
28
30
22
36

26
24
122
126
124
110
97
120
70
24
106
94
134
152
144
150
138
136
148
8.
132
140
142
130
8.
88
87
86

154
152
152
152
144
152
148
150
146

10.
24
196
190
198
192
126
162
124
27
161
161'
162'
144
163
164
164
163'
168
166
167
186
179
184
178
180
170
173
169
172
165
174
176
160
10.
165

PAPER COATING APPARATUS

This application is a continuation of our copending application Ser. No. 863,464, filed Dec. 22, 1977, which in turn is a continuation-in-part of our application Ser. No. 683,669, filed May 6, 1976 (now abandoned). The method described in this application, which the apparatus of the invention is adapted to perform, is claimed in our U.S. Pat. No. 4,250,211, which was granted Feb. 10, 1981 on a continuation-in-part of said application Ser. No. 863,464.

BACKGROUND OF THE INVENTION

This invention relates to a method and apparatus for applying a coating material to a web of paper and more particularly to a coating method and apparatus of the trailing blade type wherein light, heavy or medium weight coatings may be applied in a novel and improved manner.

A conventional coater of the trailing blade type includes means for applying, usually unpressurized, coating material to a paper web that is usually supported and carried by a resilient backing roll, together with a flexible doctor blade located some distance from and on the trailing side of the applicator, which serves to level the applied coating. In general, an excess of coating material is applied to the web, and the trailing blade then meters or removes the excess while uniformly spreading the coating onto the web surface.

In recent years, it has become desirable to produce printed papers having a minimal amount of coating, i.e., in the order of about two or three pounds of coating per ream of paper. In order to achieve low coat weights on conventional trailing blade equipment, it is necessary to increase the pressure of the trailing blade against the web, which results in a high rate of wear on the blade and necessitates more frequent replacement of the blade. High blade pressure also increases the possibility of web breakage and streaking caused by foreign particles being caught between the blade and the web.

Many conventional coaters inherently employ a relatively long dwell or soak time, which is the time interval between the initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive wet coats without intervening drying because the successive coats tend to migrate into and contaminate the previous coat.

The foregoing problems are discussed in the U.S. Pat. No. 3,348,526 issued to Neubauer wherein a narrow stream of coating is extruded onto an inverted trailing blade that defines a nip region with the supported web. The coating application is such that the coating material is unpressurized after leaving the orifice and supported on the blade or trailing side only, with the leading side of the stream being unsupported and exposed to the environs in the zone of application. Since the coating is bladed immediately after application, soak times are kept to a minimum.

SUMMARY OF THE INVENTION

The short dwell time applicator or coater apparatus of the present invention constitutes an improvement over the method described in the aforesaid Neubauer patent, in that an enclosed pressure reservoir is established between the coating applicator, the blade and the supported web, rather than simply supplying coating material to a nip region, which results in pressure application of the coating material to drive the coating into the interstices of the web surface, greater control of coat weights and fewer production problems.

The applicator generally may be used with a backing roll carrying a web of paper, or a pair of applicators may be arranged on opposite sides of the web so that a web supporting roll is not needed. The coating applicator comprises a tapered chamber leading from a supply of coating material to a narrow outlet orifice or slot and a doctor blade extending from the trailing side of the slot in contact with the web. The leading edge or front side of the chamber adjacent the slot or orifice is closely spaced from the supported web so as to form, in conjunction with the pressurized liquid flowing from the orifice, a liquid seal with the web, and the sides or ends of the orifice are sealed to the backing roll to allow the establishment of the positive liquid pressure of the chamber in the zone application, with the doctor blade simultaneously leveling the applied coating.

The coating applicator forms an enclosed pressure chamber with the web to apply a continuous narrow strip or band of pressurized coating material thereto, which enables application of lower coat weights than have heretofore been feasible. The maintenance of positive pressure in the zone of application, attained by the provision of the trailing blade, the end seals and the leading edge liquid seal, allows for more uniformity and control of application than with prior art methods and permits the use of lower viscosity and lower solids content coating materials than have previously been thought to be feasible.

The coating applicator of the present invention can also apply heavyweight coatings on the order of fifteen pounds per ream (per side) with fewer streaks and scratchs than coaters previously used to apply such type coatings. Likewise, it can apply coatings ranging between two and fifteen pounds per ream with superior results.

These and other advantages of the method and apparatus of the present invention will become apparent from the following written description and the accompanying drawings.

DESCRIPTION OF THE SEVERAL EMBODIMENTS

Figure 1:
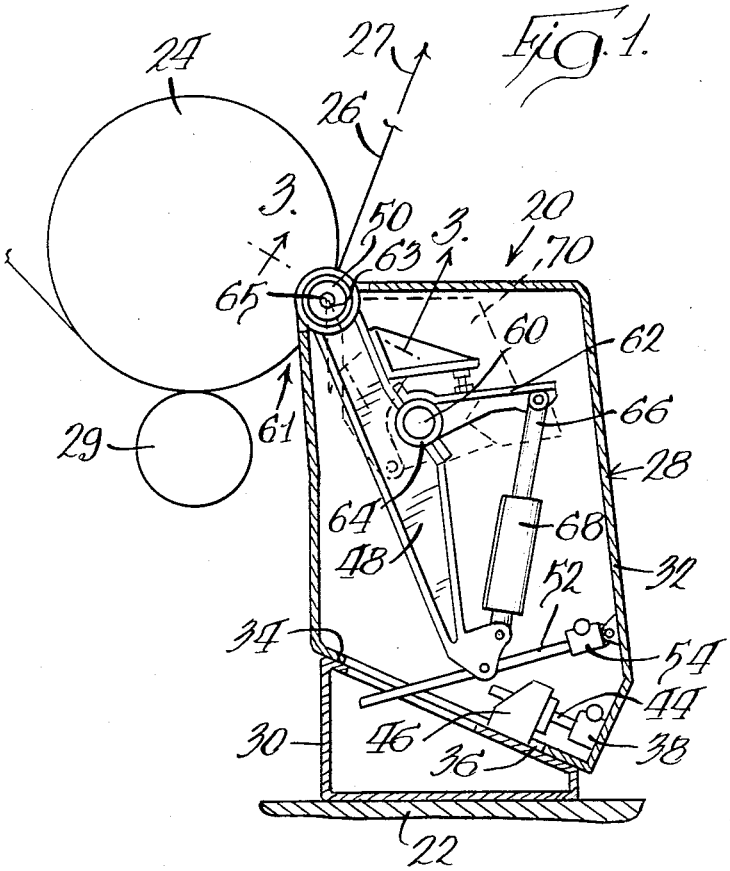
FIG. 1 is a side elevational view of one embodiment of a short dwell time applicator of the present invention installed on a paper coating machine.
Figure 2:
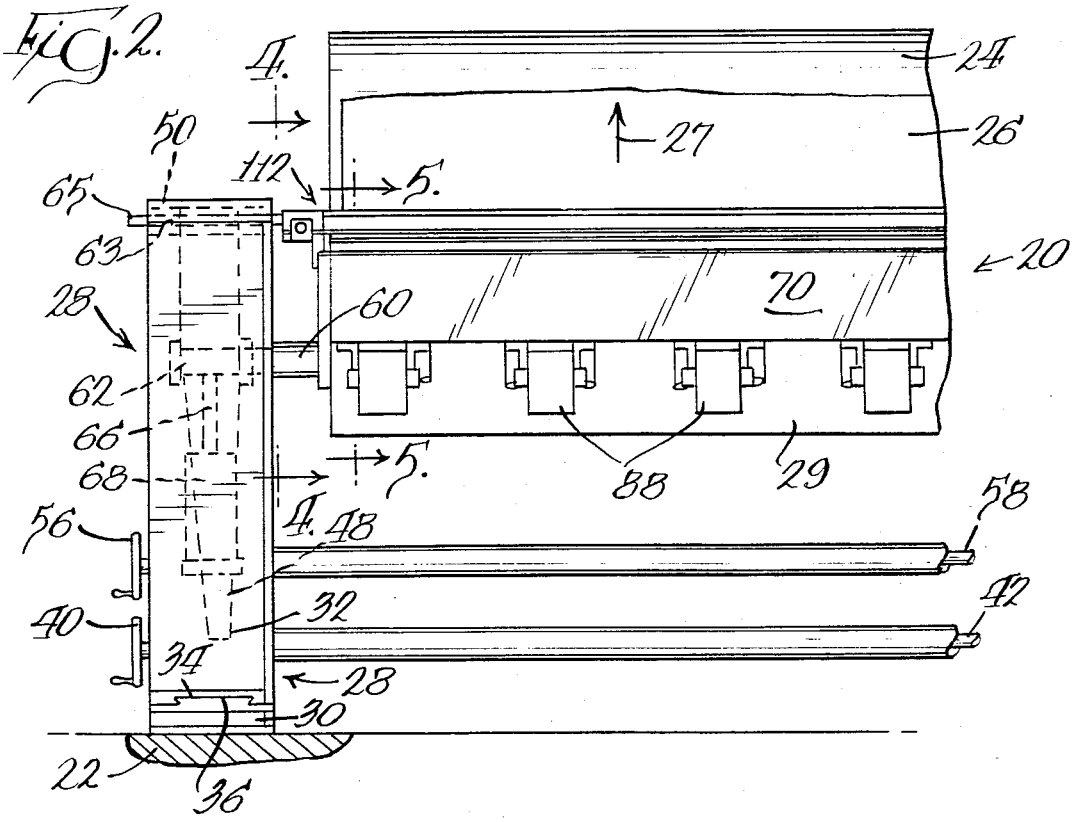
FIG. 2 is a partial cross-machine elevational view of the applicator and machine shown in FIG. 1.

Referring to FIGS. 1 and 2, a first embodiment of short dwell time applicator 20 of the present invention, or apparatus suitable for practicing the coating method of the present invention is installed on a paper making or coating machine having a frame 22 and a rotating, resilient backing roll 24 carrying a web 26 of paper moving in the direction indicated by the arrow 27. Unlike in many prior devices, instead of the more usual 180 degree wrap, the web 26 wraps around the backing roll 24 for less than 140 degrees, with the applicator being located near the end or on the last 20 degrees wrap.

Due to the compact arrangement of the applicator 20, one or more other coating devices may be located ahead of the applicator on the same backing roll 24. One such device comprises a rotatably mounted dip roll 29, the lower surface of which is disposed in a pan of coating material (not shown) and the upper surface being tangentially in contact with the backing roll. The dip roll 29 may be accompanied by its own doctor blade (not shown).

The low soak or dwell time of the coating supplied by the applicator 20 enables the application of a final coating over one or more wet primary coatings without intervening drying. So called "wet-on-wet" methods of coating application are especially advantageous with the present applicator since the final coat may be composed of expensive high-quality materials which may be applied at a very low rate without affecting good web coverage or printing qualities.

The applicator 20, may be suitably mounted on a pair of pedestals or bases 28 (only one being shown) secured to the frame 22 of the machine. Each of the bases 28 comprises a lower portion 30 and an upper portion 32. The lower portion 30 is secured to the machine frame 22, as by bolting. The lower and upper portions 30 and 32 have cooperating dovetailed, inclined and slidable mating surfaces, 34 and 36, respectively, to permit relative lateral adjustment of the position of the coater applicator 20 for use with various diameter backing rolls 24. The angle of inclination of the surfaces 34 and 36 and dimensions and placement of the bases 28 with respect to the rotating axis of the backing roll are chosen so that the upper portions 32, generally, need only be moved across the inclined surfaces 34 to adjust the position of the applicator 20 for a change in the diameter of the backing roll used without altering the relative angle at which the applicator contacts the backing roll.

For convenience of making this adjustment and increased accuracy of the same, the upper portions 32 on each side of the backing roll 24 are made to move simultaneously the same distance. To accomplish this result, a screw jack 38 is secured to each portion 32, the two jacks 38 being connected together by a rotating shaft 42 contained in a tubular housing. Upon rotation of the single handle 40, the screw jacks 38 cause two screw shafts 44 to rotate. The shafts 44 move in female threads in bodies 46 secured to the lower portions 30. Thus, rotation of the handle 40 cause both upper portions 32 to move along the inclined surfaces 34 relative to the lower portions 30 to adjust the position of the coating applicator 20 with respect to the axis of the backing roll.

In addition to the adjustment feature discussed above, a second adjustment is provided on the bases 28 to vary the relative angular position of the coating applicator 20 with respect to the backing roll 24. Again referring to FIGS. 1 and 2, large arms 48 are pivotally mounted on a pair of short shafts 50 to the upper portions 32 of the bases. The loci of shafts 50 are chosen to coincide generally with the line on which the applicator 20 will contact or be generally tangent to the backing roll 24. The lower end of each arm 48, pivotally carries a female threaded portion (not shown) which engages a screw shaft 52. The pair of screw shafts 52 extend from a pair of screw jacks 54, which are operated by a common handle 56 and connected together by a rotating shaft 58 in a manner similar to jacks 38. Thus, upon rotation of the handle 56, the arms 48 can be made to simultaneously pivot an equal angle or amount about the shafts 50. As the coating applicator 20 is pivotally mounted about a pair of shafts 60 carried intermediate the ends of the arms 48, pivoting of the arms 48 changes the relative position of the coating applicator 20 with respect to the backing roll 24.

Figure 3:
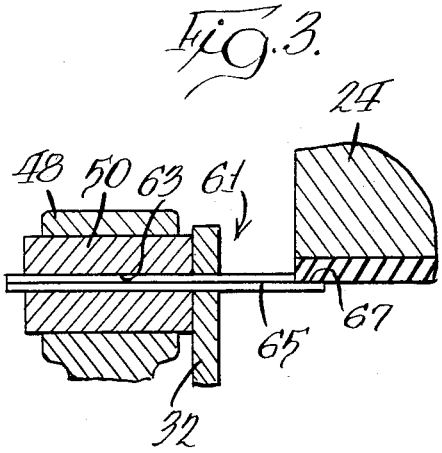
FIG. 3 is a cross-sectional view taken substantially along the line 3—3 of FIG. 1.

Referring to FIG. 3, to accurately locate the applicator 20 substantially tangent to the surfaces of the various diameter backing rolls and to reduce the time required in making such adjustment, base locating means 61 are provided on each base 28. Each locating means 61 comprises an opening 63 formed on the base parallel to the axis of the backing roll and located concentrically in the shaft 50. Locating means 61 also includes a locating rod 65 having its outer end slidably mounted in the opening 63. The inner end 67 of the rod is ground flat and semicylindrical so that the axis of the rod lies on the flat surface. If desired a clamp (not shown) can be provided to hold the rod 65, or the rod can be withdrawn when not needed. In setting up apparatus 20, the rods 65 would be installed in the openings 63 and the upper portions 32 of bases 28 moved up or down the inclined surfaces until the flats of the rods 65 are tangent to the outer surface of the the particular size backing roll being used. After such position is reached the rods 65 may be removed or clamped in out-of-the-way positions. Thus, the upper portions 32 of the bases 28 may be readily positioned with respect to the lower portions 30 so that the axes of the openings 63, shafts 65 and applicator 20 are generally tangent to the surface of the selected diameter backing roll to be used.

In addition to the foregoing adjustment, the bases 28 incorporate mechanisms to quickly place in or remove the coating applicator 20 from its operating position abutting the backing roll 24. An arm 62 may be connected at one end 64 to the coating apparatus 20, while its other end is connected to a piston rod 66. The lower end of the rod 66 cooperates with an air cylinder 68, which in turn is connected to the lower end of the arm 48. With the rod 66 extended from the cylinder 68, the coating applicator 20 is moved toward the backing roll 24 to its operating position, and with the rod 66 retracted into the cylinder 68, the coating applicator 20 is moved away from the backing roll as required for a shutdown or performing maintenance or cleaning. Appropriate controls (not shown) are provided for the operator to regulate these movements, and adjustable mechanical stops may be provided to determine the exact location of the operating position with respect to the roll.

As an alternative, arms 62 previously described, may be replaced by a pair of clevis brackets 74 (FIG. 4) secured to the ends of the applicator 20, the ends of the brackets 74 being connected to the piston rods of the air cylinders 68 for urging the applicator toward and away from the roll.

As shown in FIGS. 1, 2, 4 and 5, the applicator 20 comprises a main support beam 70 of rectangular cross-section, which extends adjacent and coextensively with the backing roll 24. The main beam carries either arms 62 or brackets 74. A rear wall 76 (FIG. 5) of the coating applicator is secured to the front side of the beam 70 and extends coextensively with and generally parallel to the backing roll. A front wall 78 is mounted adjacent to and spaced from the rear wall, the walls being inclined toward one another and together defining an enclosed chamber 80 converging toward the backing roll. One or more inlet pipes 82 connected to the bottom portion of the rear wall 76 supply the chamber 80 with pressurized liquid coating material from an external header (not shown), the chamber 80 having an open top and being enclosed and sealed at its sides by end plates 84 (FIGS. 4, 5 and 6), which engage sealing ledges 83 secured to the side of the applicator.

The front wall 78 is pivotally mounted with respect to the rear wall 76 and is movable away therefrom to enable opening of the chamber 80 for cleaning and also to regulate the width of the metering slot 85 between the upper edges of the walls 76 and 78. The front wall 78 is separable from the rear wall 76 and is connected to the ends of downwardly extending levers 86, the other ends of which are connected to piston rods 87 of power cylinders 88, which in turn are pivotally connected to the beam 70. The levers 86 are fulcrumed intermediate their ends on pivots 90 which are also secured to the beam 70. Retraction of the rods 87 of the cylinders 88 cause the front wall 78 to pivot away from the rear wall 76 to an open position shown in FIG. 6, thereby opening up and giving access to the interior of the chamber 80. Extension of the rods 87 close the chamber to ready the coater for operation. In the operating position, the lower ends of the front and rear walls abut one another or seal against each other to prevent escape of coating materials, the area of abutment containing a seal 92 (FIGS. 5 and 6) to prevent loss of pressure during operation of the coater.

Figure 5:
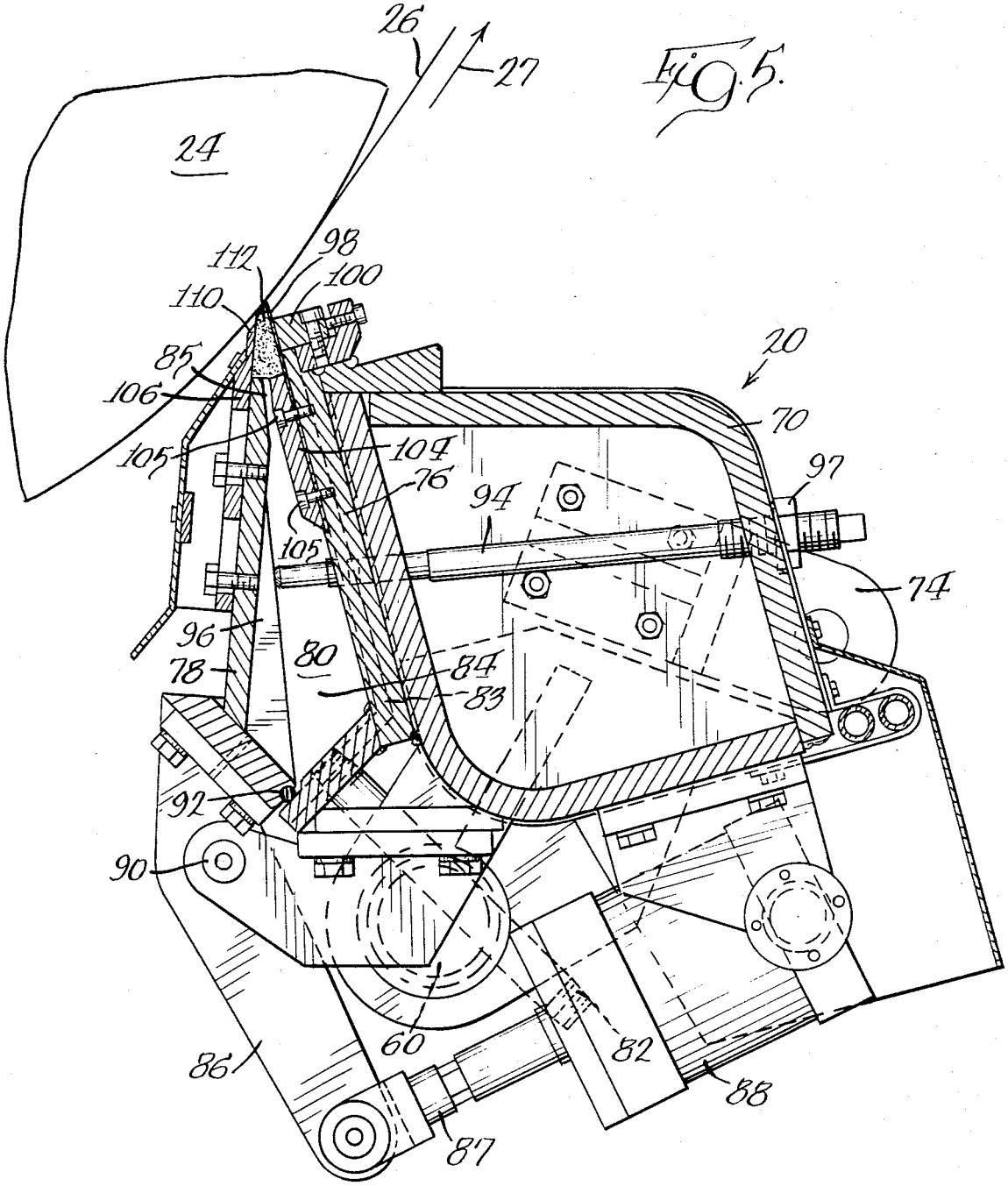
FIG. 5 is a further enlarged view taken substantially along the line 5–5 of FIG. 2 with the applicator in an operating position.

Means are provided to fixedly adjust the distance between the front wall 78 and rear wall 76 and hence to regulate the width of a metering slot 85 and the amount of coating material passing therethrough. As shown in FIG. 5, a series of bolts 94, which pass through the beam 70 in threaded engagement therewith, extend into the chamber 80 and abut internal webs 96 on the front wall. Adjustment of the bolts 94 to fixed positions held by stop nuts 97 abutting the beam determines the final spacing between the walls 76 and 78 and the width of the metering slot 85 when the chamber 80 is closed. The bolts 94 may also be adjusted individually to insure that the width of the slot 85 is uniform or is of the desired shape along its entire length.

Figure 6:
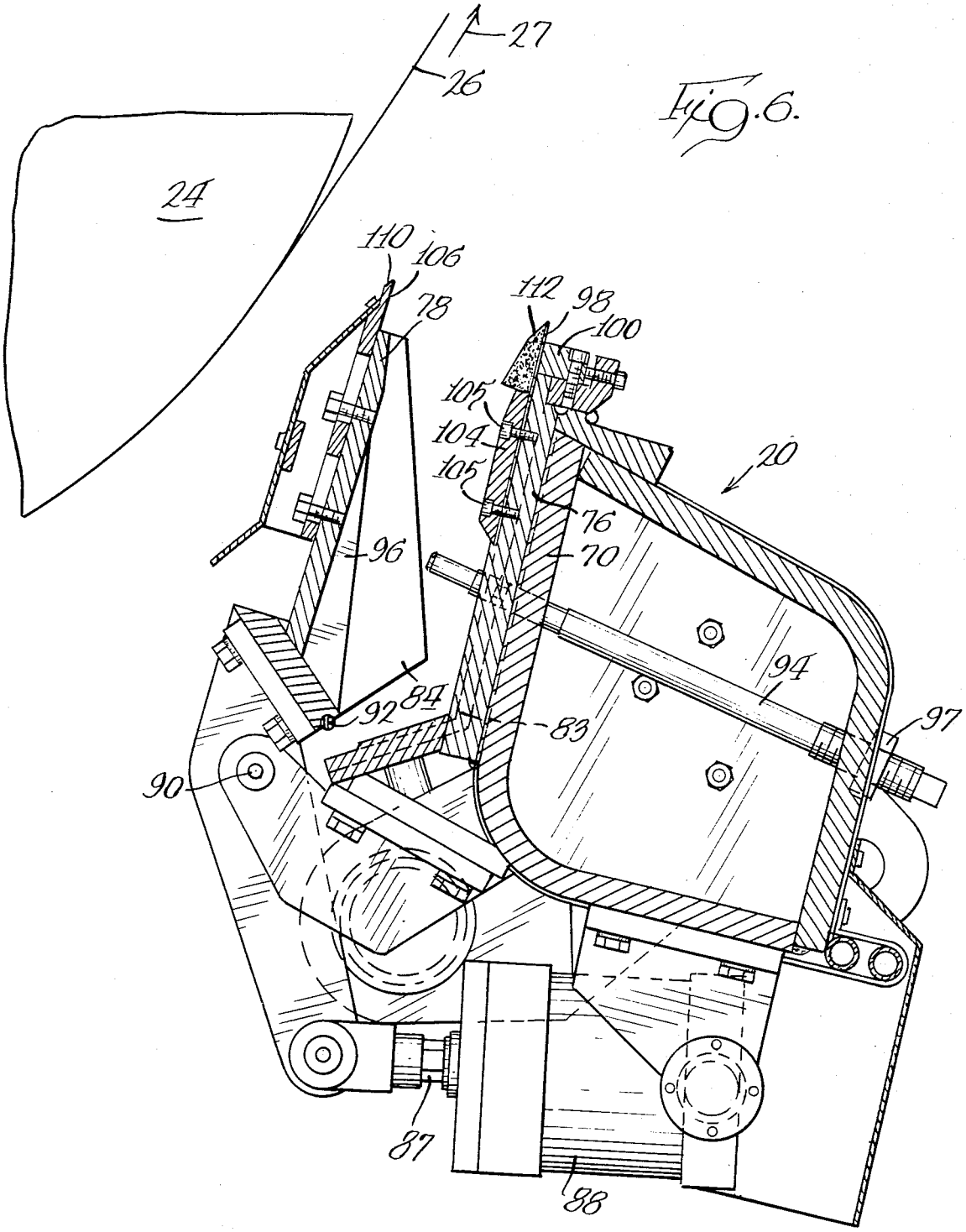
FIG. 6 is a view similar to FIG. 5, but with the applicator open in a cleaning position.

During operation, the coating applicator 20 is positioned closely adjacent the backing roll 24 with the metering slot 85 facing the surface of the paper web 26 on the roll. A flexible doctor blade 98 is fixedly clamped to extend from the rear wall 76 into engagement with the web supported on the backing roll, the rear side of the blade being supported by a backing bar 100 secured to the rear wall. The blade is held in a slot between a backing member 104 and the rear wall 76 and may be conveniently removed by sliding the blade laterally, parallel to the backing roll, when the chamber 80 is open as shown in FIG. 6. As will be hereinafter more fully explained, the blade serves several functions, one of which is to level the coating that is applied to the web. The pressure of the blade on the roll is regulated by extension and retraction of the rods 66 of the cylinders 68 connected to arms 62, or alternatively the cleavis brackets 74, which rotate the coating applicator beam 70 about the shafts 60 toward and away from the backing roll 24.

Figure 4:
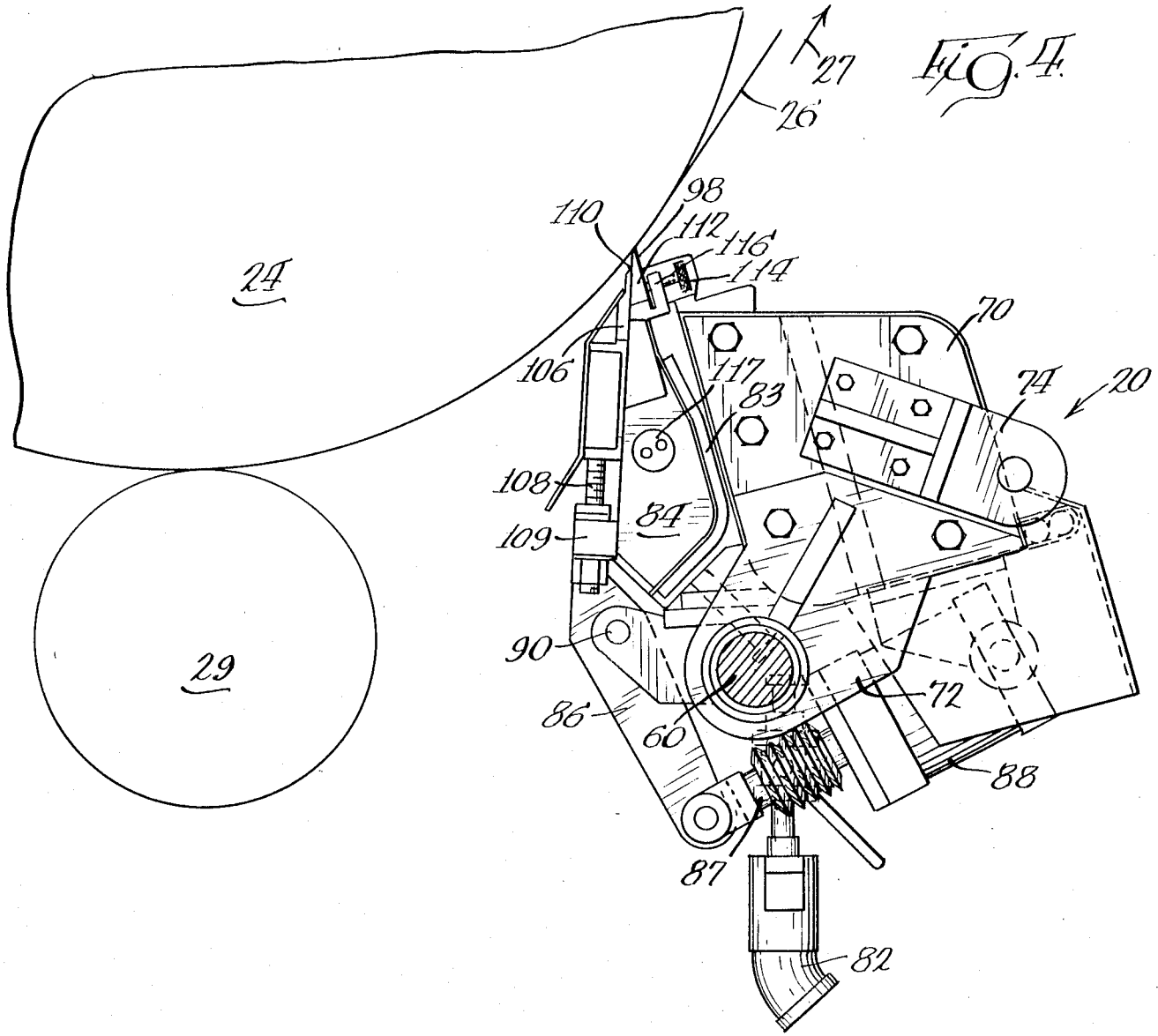
FIG. 4 is an enlarged cross-sectional view taken substantially along the line 4–4 of FIG. 2.

In order to close the forward edge of the chamber 80, a liquid seal is established between the web 26 and the applicator 20, and more particularly an orifice plate 106 thereof. The orifice plate 106 is slidably and adjustably mounted on the outside surface of the front wall 78 to be movable toward and away from the backing roll 24. As shown in FIG. 4, the extension of the plate 106 may be fixedly adjusted by a bolt 108 rotatably mounted at one end in a journal 109 extending from the front wall 78, and the other end being in threaded engagement with the plate. The spacing between the free edge 110 of the plate 106 and the backing roll is very important and should be less than one inch to allow for maintenance of the liquid seal between the plate and the supported web.

The trailing blade 98 and forward orifice plate 106 in effect form a portion of an enclosed secondary chamber or reservoir (downstream of the metering slot 85), the ends of which are enclosed and sealed by flexible triangular shaped end dams 112, which may slightly contact the backing roll surface. The end dams 112 are held in compression against the orifice plate 106 by the loaded blade (FIG. 5) and secured by screws 114 (FIG. 4) threadably mounted in brackets 116 secured to both ends of the front wall 78. Loading of the blade 98 against the backing roll 24 causes the blade to deflect inward at its center and increase the seal of the end dams 112.

As the coating applicator 20 forms an enclosed pressure reservoir with the backing roll, liquid coating may be applied across the web in a narrow band or strip under positive pressure. The enclosure is completed by the web on the backing roll, the blade 98, the end dams 112 and the liquid seal formed between the orifice plate 106 and the web. Although when out of operation there is a slight space between the orifice plate and the backing roll or web, the spacing is sufficiently narrow to allow the liquid seal of coating material to form between the plate edge 110 and the supported web during operation to prevent loss of pressure so that coating is applied to the web at or near the pressure in the chamber 80. One advantage is that this latter pressure can be readily measured by mounting a pressure tranducer 117 in the end wall 84 of the chamber 80. The pressure reading of the tranducer can then be monitored by the operator and the flow of coating material adjusted to maintain the desired pressure, as will be discussed later.

In operation, the inlet pipes 82 are connected to a source of coating material, which is pumped under pressure into the chamber 80. The coating material may comprise any known composition, such as a mixture of fine clay pigment and a binder in an aqueous medium. A typical coating composition may include, for example, a mixture containing 100 parts clay, 16 parts enzyme converted starch and 0.8 parts calcium stearate, said mixture comprising 50 to 60 percent of an aqueous coating composition.

The liquid coating material is supplied to the chamber 80 at a rate to maintain it at from about $\frac{1}{4}$ psi or 7 inches water to about 5 psi or 150 inches water and through the metering slot 85, which insures uniform distribution of the coating to the web. A very slight or small pressure loss occurs in the metering slot 85 so that the coating is applied to the web at substantially the pressure in the chamber 80. The liquid seal between the free edge 110 of the orifice plate 106 and the web surface assists in maintaining such condition. With the arrangement shown, the coating material flows under pressure upward from the chamber 80 and into contact with the web in a narrow band defined by the space between the blade 98 and the liquid seal on the orifice plate 106. As mentioned previously, the gap between the orifice plate and the web surface is very important since it allows a continuous band or strip of pressurized coating material to be deposited on the web, while at the same time, maintaining the non-abrasive liquid seal with the incoming web. The excess coating that flows in a direction opposite the web is allowed to escape through the liquid seal to the exterior of the coating applicator. This flow of excess coating serves to maintain a degree of limited circulation in the zone of pressure application, serves to continuously purge the otherwise enclosed system in the zone of application, strips air from the moving web, and prevents air from entering the applicator where it would prevent the coating contacting the web and would cause streaking or skips.

The distance between the blade 98 and the orifice plate 106 (wetted length of web) may be adjusted by means of the bolts 94 to regulate the width of the band of coating applied to the web and hence the dwell time of the coating on the web between application and wiping. Preferably, the wetted length is adjusted between about $\frac{1}{4}$ and $2\frac{1}{4}$ inches, with about $\frac{1}{2}$ to $1\frac{1}{2}$ inches being optimum, so that the coating material is applied onto the web and doctored within from 0.004ths to 0.0100ths of a second.

Thus, coating pigment is applied to the web surface in sufficient quantity and under pressure to give a uniform, high-grade coating, but the coating liquid remains in contact with the web only an extremely short time before being doctored so that little liquid penetrates into the web. As a result, low coat weight papers can be obtained using higher solids content coatings which require less fuel to dry at equivalent coating weights. Also, the paper prints better and tends to have less fiber rise and blistering.

Because the supply of coating material is essentially self-contained, a break in the web or other malfunction creates only minimal problems in comparison with other prior systems, wherein losses of large amounts of coating materials and extensive cleaning operations are to be expected. If a malfunction occurs with the present applicator, the flow of coating material is stopped, as by cutting off the source of pressurized coating. The coating apparatus may then be tilted away from the backing roll and wiped clean, with no concern about clogging of the applicator with hardened coating material, since the supply of coating material is self-contained.

Cleaning of the interior of the chamber is facilitated because of the pivotally mounted front wall 78. The interior of the device may be completely exposed for cleaning by first pivoting the coating head away from the backing roll on the shafts 60 and then retracting the rods 87 of cylinders 88 to pivot the front wall 78 away from the rear wall 76, such that the applicator assumes a position shown in FIG. 6.

The present method and apparatus is particularly suitable for use as the final applicator for so-called "wet-on-wet" coatings, wherein another coating applicator, such as that indicated at 29 in FIG. 1, precedes the applicator 20 without intervening drying. Because of its short dwell or soak time, the present apparatus and method minimizes possible contamination of the first coat by the second coat.

A distinct and important advantage of the present invention resides in the ability of applying extremely light weight coatings without applying excessive blade pressure to the web. In most prior art methods, coat weight is reduced by increasing blade pressure against the web, with the result that blade wear and the possibility of web breakage are increased, thereby necessitating costly and time consuming shutdowns. In fact, increasing blade pressure past a certain point will not achieve significantly lower coat weights, and a coat weight of less than about 2.5 pounds per ream is impossible or impractical with most conventional equipment, such as a dip roll and inverted blade. This latter method, for example, has been found to require about 9.8 pounds per lineal inch (pli) of blade pressure to achieve a 3 pound per ream coating, whereas about 6.6 pli of blade pressure is sufficient for the same weight with the present invention, and about 7.4 pli will achieve a coat weight of about 2 pounds per ream. It should be understood that blade pressures in excess of 9 pli are highly impractical and expensive to operate at in terms of wear and shutdowns, and hence this benefit of the present invention becomes readily apparent. The use of lower blade pressures are possible as the metering or doctoring of the coating occurs before the coating has had time to significantly dewater on the sheet of the web. By metering when the coating has not dewatered and the deposited coating layer is more mobile, there is a reduced tendency for the blade to scratch the web. Also, the absorbency of the paper has less influence on coating pick up than in conventional applicators with long application times.

The above benefits are achieved because a lower soak time forces the coating to remain on the surface, rather than penetrate into the web so that fewer fibers become soaked, thereby resulting in better coverage with less exposed fibers. The coating produced by the present method is also porous, which is advantageous for printing, and moreover a dense or nonporous sheet may blister while being dried.

From the foregoing, it may be seen that the enclosed coating system incorporating a liquid seal at the leading edge of the applicator allows for several benefits, including even and complete coverage of the web, particularly at low coat weights, and the establishment of an even or equalized coating pressure across the width of the web. The liquid seal also eliminates the necessity of solid contact with the web on the leading edge of the applicator, thereby minimizing marking or scratching of the web surface.

The applicator of the present invention, though primarily developed to apply lightweight coatings, on the order of two pounds per ream (per side) or less, is capable of applying medium and heavyweight coatings, on the order of fifteen pounds per ream at both high speeds, low speeds and intermediate speeds. With this applicator there is little or no tendency to cause scratching, streaking and/or skipping as this applicator can coat paper with lower doctor blade pressure on the web than was possible with previously type coaters, and it doctors high solids content coating before the physical properties of the coating are adversely affected due to dewatering.

Figure 7:
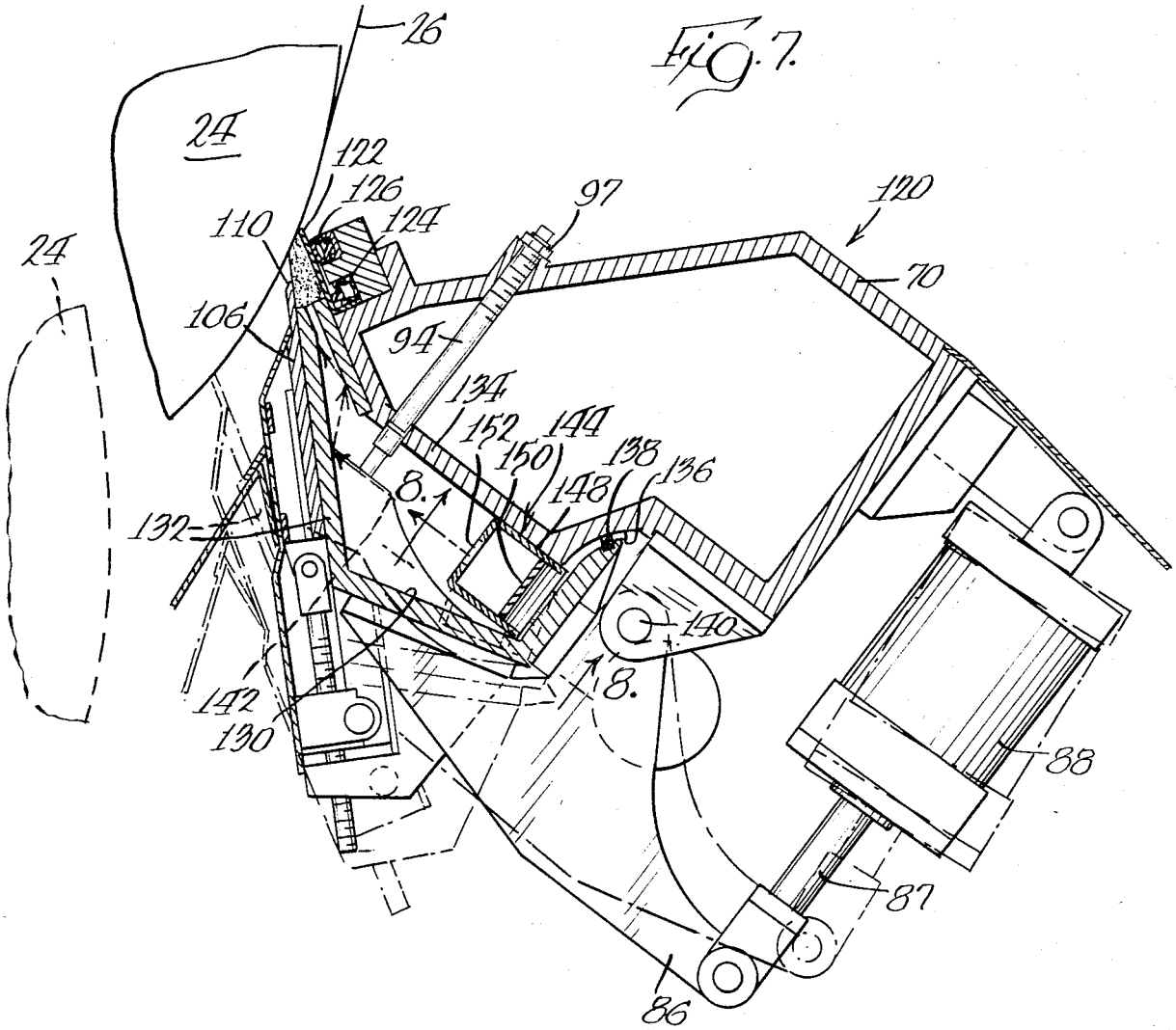
FIG. 7 is a cross-sectional view of a second embodiment of short dwell time applicator in an operating position, the applicator being shown in a cleaning position in dotted lines.

Referring to FIG. 7, a second embodiment of applicator 120 of the present invention and for practicing the method of the present invention is shown and is generally similar to the applicator 20. Similar elements, parts, or portions of the applicator 120 will be given the same reference numeral as used for the corresponding elements, parts, or portions of applicator 20. Applicator 120 has certain features which are improvements over those of applicator 20, and such improved features will now be described in detail.

One change noted is that the doctor blade 122 is clamped or held in place or position by an air tube 124. The use of the air tube 124 to clamp the blade provides the advantage of being able to simply remove or replace the blade 122 by relaxing the air tube, i.e., reducing the pressure therein, and slipping the blade out from either the front (operator) side or back side of the machine. To assist in locating the blade it can be provided with detents on its lower edge to locate the blade spacially in the applicator. The air tube 124 also acts to seal the coating chamber 130, adjacent the end of the blade.

A second air tube 126 is provided above the air tube 124 and is used to uniformly load the blade toward the backing roll 24 independent of the relative position of the applicator to the backing roll. The blade loading resulting from pressurization of the air tube 126 is more uniform along its entire length than it would be if a plurality of mechanical devices, such as screws, spaced along the blade, were used. Further, the exact blade loading condition is easier to duplicate as air pressure is easier to control. Also, the air tube 126 allows the blade 122 to be loaded toward the backing roll without altering the gap between the orifice plate tip 110 and the backing roll 24 so that the fluid seal is maintained.

Like the chamber 80 of applicator 20, the chamber 130 of applicator 120 may be opened for cleaning, as is shown in dashed lines in FIG. 7. Prior to being opened, the applicator is moved away from the roll, and it will be understood that the roll 24 shown in dashed lines is included only to illustrate the relative positions of the open coater and the roll, since the roll is not actually moved. The chamber 130 of applicator 120 opens only at the top end, and the bottom end of the front wall 132, unlike in applicator 20, remains closed and sealed to the rear wall 134. The rear wall 134 is arcuate, as indicated at 136, to accomodate the movement of a seal 138 on the front wall 132 The forward wall 132 pivots about a fulcrum 140 on the rear wall. Aside from the advantage of the open chamber forming a trough to contain the water used to flush the chamber 130 during cleaning, another advantage of this construction is that the seal 138 and arcuate sealing surface 136 on the rear wall are swept clean each time the chamber is opened or closed to minimize possible contamination of the seal or sealing surface.

Rather than being straight, the rear wall 134 and front wall 132 forming chamber 130 are angular so that as the coating liquid flows from the lower end of the chamber 130 toward the upper end the liquid tends to be deflected first off the front wall, then off the rear wall and again off the front wall to cause a more uniform mixing and distribution of the coating liquid, this path being indicated by the dotted arrow 142.

Figure 8:
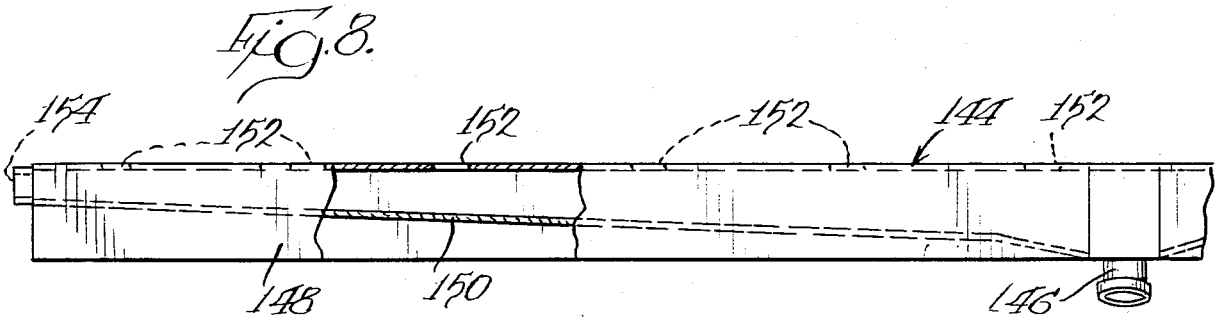
FIG. 8 is a cross-sectional view taken substantially along the line 8—8 of FIG. 7 showing one half of the applicator's internal header with portions broken away, with other portions of the applicator not being shown.

Referring to FIGS. 7 and 8, another advantage of applicator 120 over applicator 20 is that an internal header 144 has been incorporated within the chamber 130 itself. Now, instead of having a plurality of pipes (as pipes 82 in applicator 20) to supply coating material to the chamber, a single large diameter pipe 146 supplies the internal header. The header 144 itself comprises a rectangular cross-sectional tube 148 of sufficient size to supply the quantity of coating material to the chamber. To assist in uniformly distributing the coating material a baffle or false floor 150 is provided in the header to taper or reduce the flow area as the material flows away from the center inlet 146. To distribute the coating material to the chamber 130, a plurality of equally sized, equally spaced openings 152 are provided along the upper surface of the header, and these openings empty directly into the chamber. To assist in clean up, a flush opening 154 closeable by an appropriate valve (not shown) is provided at each end of the header so that with the valves open the header can be flushed clean and drained through the center pipe 146, as will be described later.

Figure 9:
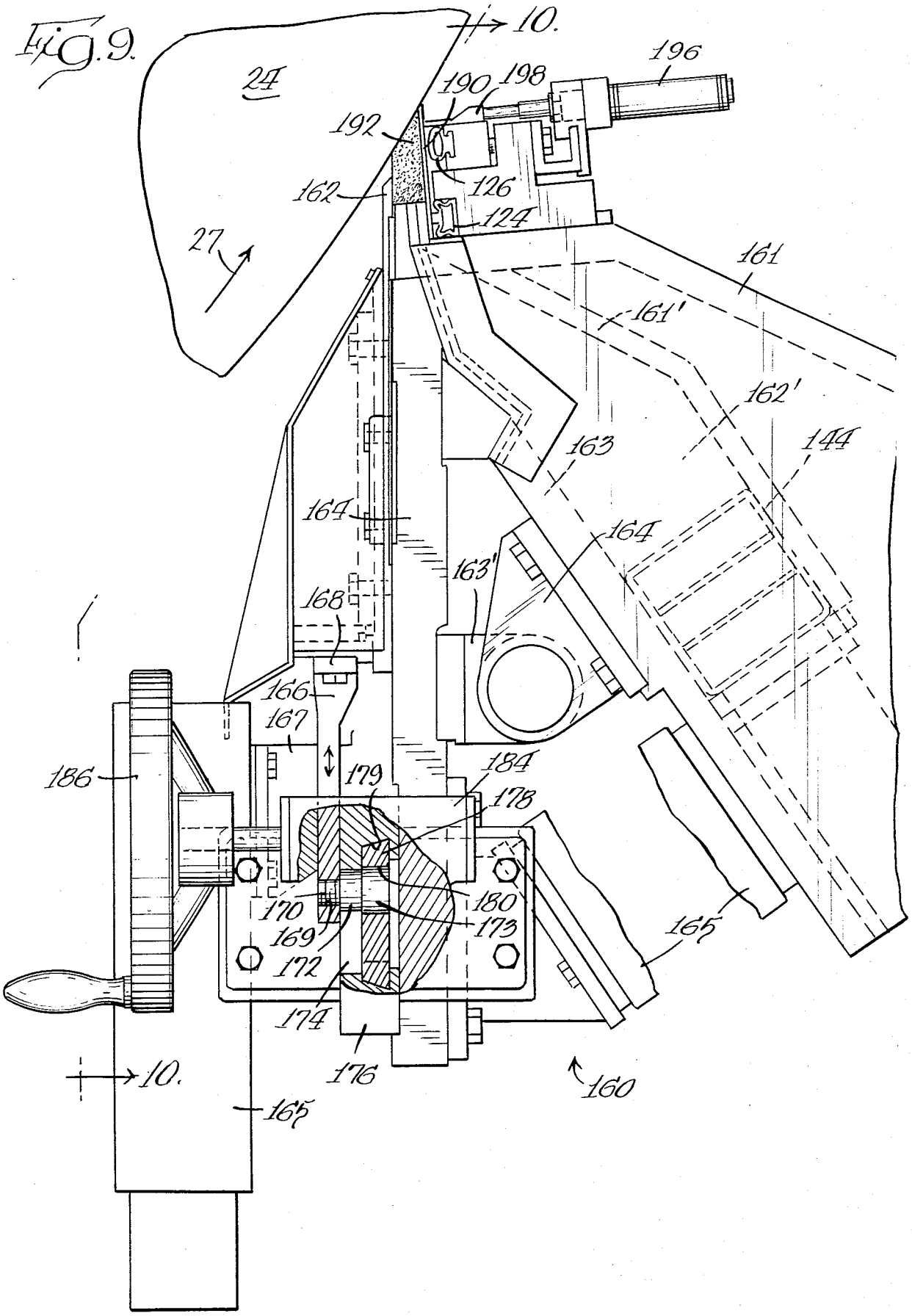
FIG. 9 is a side elevational view of a third embodiment of short dwell time applicator in an operating position.
Figure 10:
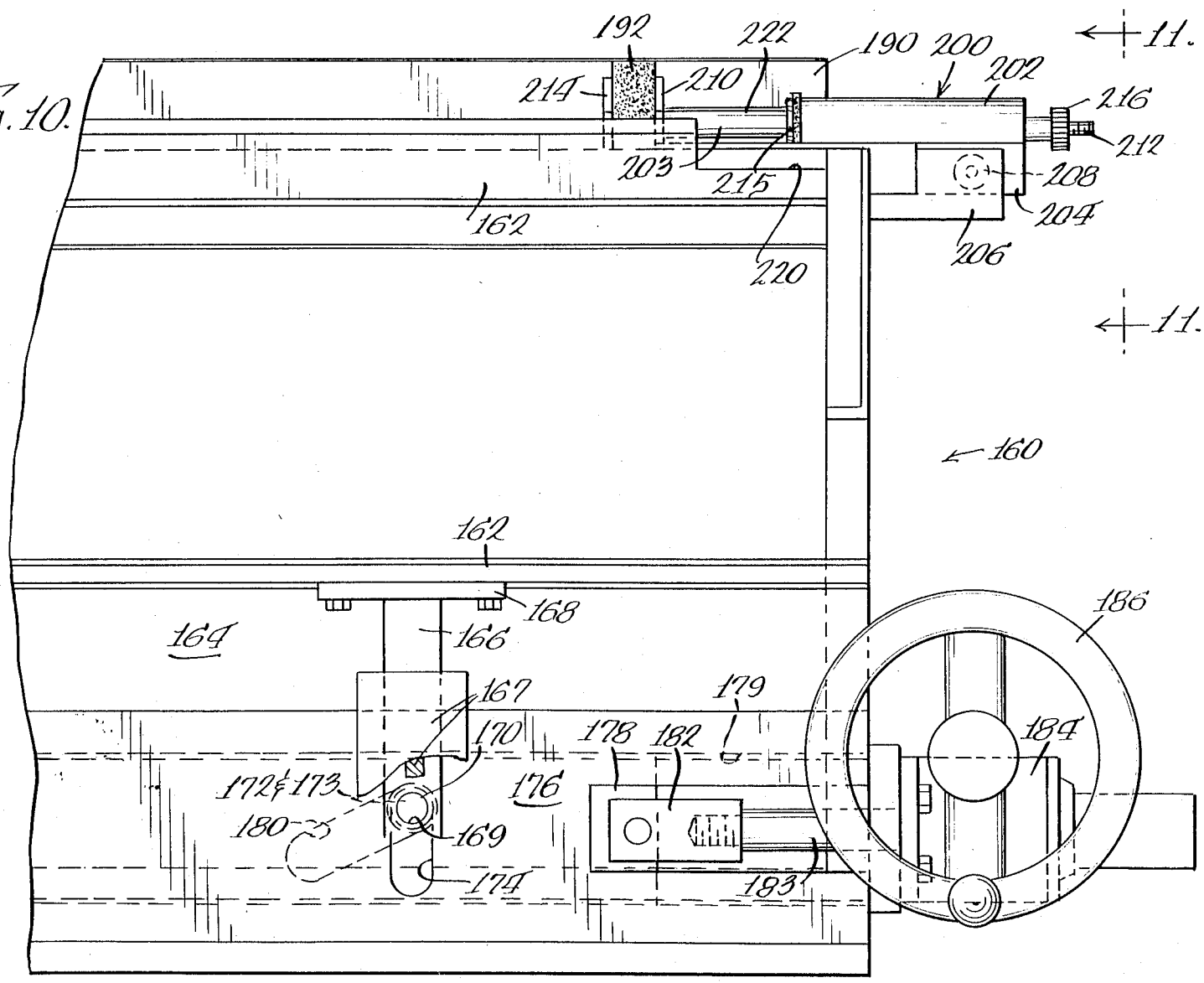
FIG. 10 is a partial cross-machine view taken substantially along the line 10—10 of FIG. 9.
Figure 11:
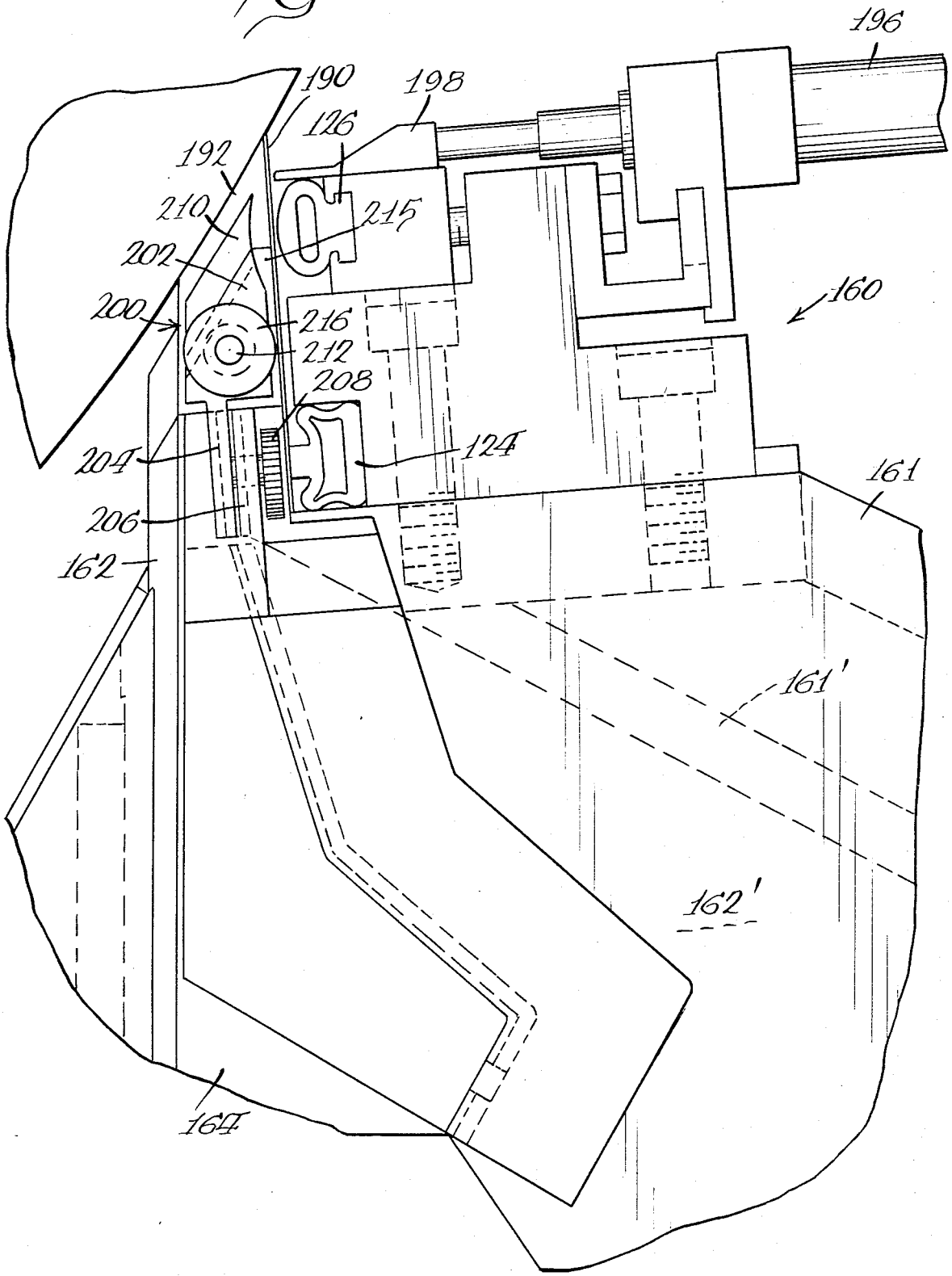
FIG. 11 is an enlarged view taken substantially along the line 11—11 of FIG. 10.

Referring to FIGS. 9, 10 and 11, a third embodiment of applicator 160 of the present invention and for practicing the method of the present invention is shown and is generally similar to the applicators 20 and 120 previously described. Applicator 160 includes a main beam 161 providing the rear wall 161' of the chamber 162' and a forward portion 163 thereof. The remaining forward portion of the chamber 162' is provided by a front wall 164 which seals with other portions of the chamber and is mounted on arms 163' pivoting on brackets 164' carried on the forward portion 163. A header, such as the header 144 previously described, is located in the lower end of the chamber. Of course, should it be desired, instead of a single header, several similar type headers could be provided, and such promote more even distribution. As in the other embodiments, the front wall 164 may be pivoted away from the rear wall by a fluid device 165 having a variable volume to be filled with compressed air.

An improved adjustment is also provided for varying the position of the orifice plate 162. As shown in FIG. 9, the orifice plate 162 is slideably guided for movement in a direction parallel to and on the front wall 164 of the applicator 160, such being accomplished by any one of various conventional means. To cause such movement a plurality of operating arms 166 extend from the bottom of brackets 168 secured to the orifice plate. The arms 166 each carry a pan bracket 167 for mounting an overflow pan 165 which moves with the orifice plate. Each arm 166 at its lower end has in turn a threaded opening 169 receiving the threaded end of a shaft 170 which carries on its other end a pair of cams or rotatable rollers 172 and 173. The cams 172 engage in vertical elongated slots 174 formed in a guide bar 176 that is fixed to the front of the wall 164. A horizontally extending orifice adjustment bar 178 is carried and slidably held in a horizontal opening 179 in the guide bar. The horizontal adjustment bar 178 has a plurality of inclined slots 180 which receive the cams 173 of the shafts 170, one such slot 180 being provided for each cam 173. The horizontal adjustment bar 178 is secured by a yoke 182 to the movable screw shaft 183 of a screw jack 184 secured to the front wall. Thus, as the handle 186 of the screw jack is rotated, the adjustment bar 178 moves horizontally and causes the cams 172 and 173, shafts 170 and arms 166 to move in the vertical slots 174 and inclined slots 180, in order to adjust the relative position of the orifice plate 162 with respect to the front wall 164 and to the backing roll. The cams 173 are eccentrically mounted on the shafts 170 so that each cam may be set in a position wherein all cams 173 simultaneously engage the upper surface of the inclined slot 180 to provide uniform movement of the plate 162.

Referring to FIGS. 9 and 10, in order to increase the loading of the doctor blade 190 and end dams 192 against the backing roll to eliminate or reduce leakage, a small pneumatic cylinder 196 is mounted to the applicator 160 directly behind each of the end dams, such dams being constructed of felt or similar material. The end of the piston rod of the pneumatic cylinder 196 adjacent the end dam has a tapered or pointed tip 198 which can be forced against the rear of the blade 190 to supplement or increase blade loading at this point and increase the seal of the end dam to the backing roll. Thus, it is possible to reduce or eliminate end dam leakage by increasing the pressure provided on the blade at its ends and on the end dams, without having to use a high pressure across the entire blade. Also, such adjustment for providing additional sealing is more duplicative since the air pressure supplied the cylinders is readily controlled.

Referring to FIGS. 10 and 11, the end dams 192 are each carried in a novel holder 200 which is made of nylon, stainless steel or similar material. Each end dam holder 200 includes a first outer tubular body 202 and an inner tubular body 203. The outer body 202 has a mounting flange 204 extending from its bottom which can abut a bracket 206 fastened to the applicator to hold the body 202 to the applicator. The flange 204 and bracket 206 are held together by a knob 208 which has a threaded portion passing through a threaded opening in the bracket and in clamped engagement with the flange 204. The bodies 202 and 203 of the holder are somewhat triangularly shaped in cross-section as shown in FIG. 11 to fit in the space between the orifice plate, blade and roll. The body 203 has on its inner end a generally triangular, vertical flange member 210 which abuts one end of the dam 192. The bodies 202 and 203 have coaxial openings therethrough for receiving a rod element 212. The inner end of the rod element 212 has a similar triangularly shaped vertical flange member 214 affixed thereto for abutting the other end of the dam 192. The other end of the rod element 212 is threaded and receives a knob or nut 216 for drawing the two triangular shaped flanges 210 and 214 relatively toward each other to compress the flexible dam 192 between them and to cause the adjacent ends of bodies 202 and 203 to abut a second felt or felt-like seal 215 located therebetween. As the dam 192 is compressed between the triangular shaped flanges 210 and 214 and the felt 215 is compressed between the bodies 202 and 203, the felts tend to expand in directions normal to the pressure to increase the seal between the roll 24, orifice plate 162 and doctor blade 190 to prevent leakage past the felts. The sealing provided by dam 192 helps maintain the pressure in the chamber. An end dam of this type also has the advantages of requiring a reduced amount of felt, provides a more reliable seal, and readily facilitates blade angle adjustments by merely changing the relative position of the applicator on the backing roll.

Even with the more effective seal provided by the end dam 192, problems can arise should coating material work its way past this seal and accumulate on the outer ends of the orifice plate or doctor blade. Coating material accumulated in such places could scratch or damage the backing roll. In order to prevent coating material accumulating in such places, large relief openings or cut-aways 220 and 222 are formed or cut in each end of the orifice plate 162 and in each holder 200, respectively. Thus, should any coating material work its way past the felt seals 192, it flows over the relief cut-aways 222 and 220 in the holder and the orifice plate into the overflow pan 165 on the front of the applicator. The felt seals 215 direct the flow into the cut-aways and prevent any coating material from passing by and accumulating on the extreme ends of the orifice plate or doctor blade to scratch or otherwise damage the roll.

Figure 12:
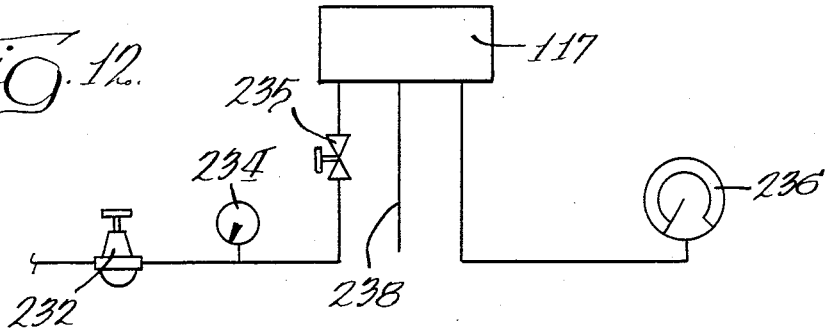
FIG. 12 is a schematic diagram of the coating pressure measurement system for the applicator.

Referring to FIG. 12, in order to measure the pressure at which the coating is being applied to the web, i.e., the pressure in the applicator chamber, a pressure transducer is mounted directly in the chamber of the applicator, such as transducer 117 of applicator 20. Of course similar transducers could be used in the corresponding chambers of any of the applicators disclosed herein. The transducer 117 is of the diaphram type and is capable of accurately measuring low pressures on the order of 200 inches of water or less, such a transducer being manufactured under the name P.M.C. Level Transmitter by Paper Machine Components, Inc. of Danbury, Conn. Air pressure is supplied from a source such as a filtered plant air supply to a pressure regulator 232, the regulator being set to maintain a specified pressure readable on the gauge 234. The pressurized air is then supplied through an adjustable needle valve 235 to the diaphram of transducer 117, wherein it is used to balance the diaphram against the pressure of the coating material. The air pressure on the air side of the diaphram may be measured on an air pressure gauge 236 which may be conveniently mounted on the machine operator's panel. When the air pressure supplied to the diaphram of the transducer is in equilibrium with the pressure of the coating material, a small amount of air may be exhausted through the port 238. As the pressure of the coating material in the chamber is substantially the same as the pressure at which the coating material is applied to the web, it can be easily determined merely by reading the gauge 236. The operator can be provided with a control, such as a speed control connected to the motor driving the coating material pump so the flow of coating material can be adjusted to provide the desired pressure.

While the above arrangement may appear complex, it should be appreciated that a more simple or direct connection of a pressure gauge to the chamber of the applicator would result in inaccurate and unreliable pressure readings due to accumulation of coating material in the connecting passage for the gauge and would soon become inoperative. This disadvantage is avoided by use of the diaphram type transducer which provides accurate readings substantially uneffected by accumulations of coating materials.

Figure 13:
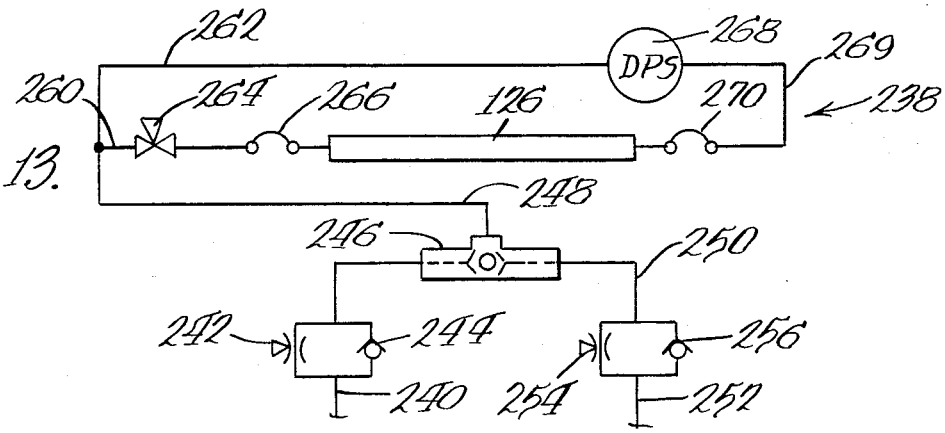
FIG. 13 is a schematic diagram of one of the air tube differential pressure failure detection systems for the applicator.

Referring to FIG. 13, separate pneumatic failure detection systems are provided for each of the blade loading and blade clamping air tubes (such as air tubes 124 and 126 of the applicator 120) to cause an alarm or automatically shutdown the machine should either of the tubes fail. Use of these detection systems prevent the possibility of damage to the machine and waste of paper stock in the event that the tubes fail. Generally these two pneumatic systems are alike, and as the pneumatic system for the loading tube is somewhat more complicated it will be fully described, but the differences between that system and the system for the clamping tube will be pointed out.

In the pneumatic system for the blade loading tube, plant air is supplied through a pressure regulator (not shown) to a zero load supply line 240; the pressure supplied by this line is adjusted, via the regulator, to that necessary to expand the loading tube (such as 126 of FIG. 6) so that the doctor blade just contacts the web or roll. The air from the line 240 flows through a flow control comprising a throttle or needle valve 242 in parallel with a check or one-way valve 244; the one-way valve 244 being connected to permit flow only back toward the line 240. In the pneumatic system for the blade loading tube, the air then flows from this flow control to a shuttle valve 246, i.e., a double ended check valve permitting air to flow from the line 240 to an outlet line 248 or from another supply line 250 to the line 248.

Pressurized air for loading the blade against the web or roll is supplied from a plant source, through a pressure regulator (not shown) to the other supply line 252. A similar flow control comprising a throttle or needle valve 254 and a parallel check valve 256 is provided between the lines 252 and 250. The check valve 246 is such that it permits flow from one of the lines 246 or 250, whichever is greater in pressure, to enter line 248 and closes off the flow from the other of the lines 246 or 250.

The flow from the line 248 divides into two branches 260 and 262. The branch 260 contains a needle valve 264 and is connected by a hose 266 to the back side of the blade loading tube 126. The branch 262 is lead across the machine and connected to one side of a differential pressure switch 268. The other side of switch 268 is connected by a line 269 and hose 270 to the front side of the tube 126. The hoses 266 and 270 are used to accommodate movement of the applicator.

The differential pressure switch 268 can be connected to operate an alarm or may be connected to the control system of the machine and can cause an alarm or shutdown the machine if the pressure in line 262 is greater than the pressure in the line 269, as would occur should the tube 126 rupture.

If the pressure in supply line 240 is greater than that in supply line 250, the blade is not forced against the web. If the pressure in line 250 is increased, then the blade is forced against the web, the force applied to the blade varying with the pressure supplied by the line 250. Should the tube 126 rupture, then the pressure in line 269 decreases more rapidly than the pressure in line 262, causing the differential pressure switch to operate and cause an alarm or a machine shutdown. Another advantage of the system is that it permits blade loading against the web to be duplicated merely by re-establishing the same air pressure in the tube 126.

The pneumatic system for the blade clamping tube, such as tube 124 of applicator 120, is similar, except that the second pressure regulator (not shown), line 252, throttle valve 254, check valve 256, line 250 and shuttle valve 246 are omitted, the throttle valve 242 and check valve 244 being connected directly to the line 248.

Figure 14:
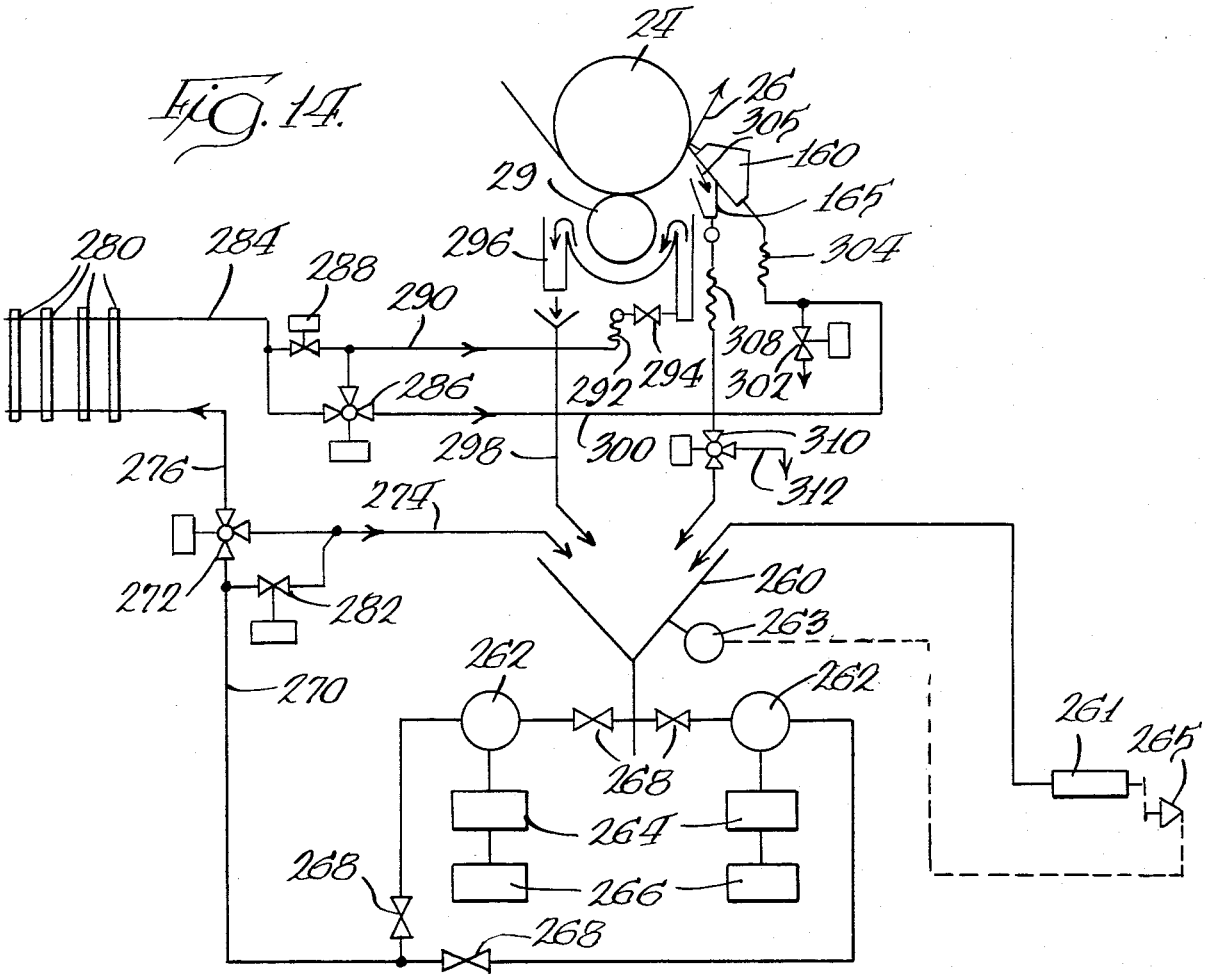
FIG. 14 is a schematic diagram of the coating supply system for the applicator.

Referring to FIG. 14, the coating supply and return system for the various embodiments of the applicator of the present invention is shown. Coating is supplied to a surge tank 260 from a source, such as the plant coating supply by a pump 261. The surge tank is maintained at the desired level by control transducer 263 controlling a variable speed pump motor 265. Coating material from the surge tank is drawn by either or both pumps 262, powered through gear reduction units 264 by motors 266. Valves 268 are provided so that either one or both of the pumps 262 may be used. The coating is then pumped through a pipe 270 to a three-way valve 272. In operation, the valve 272 is positioned to cause the coating material to flow through a pipe 276 to a plurality of filters 280. Should it be desired, the coating material flow can be bypassed through a valve 282 from pipe 270 to pipe 274 and back to the surge tank.

After passing through the filters, the coating material is conducted through a pipe 284 to a selector (three-way valve) 286 from which it can be sent to either a prior or first coater, such as the dip roll inverted blade coater 29 (FIG. 1) located on the backup roll 24, or to the applicator of the present invention, such as applicator 20, 130, or 160. Should it be desired to use both the dip roll coater and the applicator of the present invention for a "wet-on-wet" application, the ball valve 288 may be opened to provide coating material to the dip roll coater, while valve 286 permits flow of coating material to the applicator of the present invention.

To supply the initial coater 29, coating may flow from the valve 288 or 286 through a pipe 290, a hose 292, and a valve 294 to the dip roll coater pan 296. The roll 29 rotating in the pan 296 applies the coating material to the web, but some of the coating material overflows the pan and flows back through a pipe 298 to the surge tank 260.

To supply coating to the present applicator, coating flows from the valve 286 through a pipe 300, past a tee for a drain valve 302, through a hose 304 to the header, such as the header 144, of the applicator.

At the applicator the coating material is applied to the web, and a quantity, indicated by the arrow 305, flows from the liquid seal or past the end dams felts 192 and is collected in the overflow pan 165. This overflow material can then flow through a hose 308 to a three-way valve 310, from which it can be directed to the surge tank 260 or to a drain, indicated by the arrow 312, depending on the position of the valve.

Normally when the coating applicator of the present invention is in use, coating material is continuously supplied from the surge tank 260 to the applicator with a quantity of coating flowing back to the surge tank.

Should the machine shut down, as would occur on a web break, it is essential that the flow of coating material be stopped immediately to prevent the coating material from being applied onto the backing roll instead of the web. With coating material applied to the roll, the web may tend to wrap up around the roll as the machine coasts to a stop. Such a "wrap up" increases down time as the wrapped, coated web can be difficult to remove from the roll. Further, during a shutdown without a web break, unless the coating flow is stopped immediately, an increased amount of coating is applied to the slowing web so that the dryer canvas can become loaded with excess coating material causing further delays.

These difficulties are averted by the provision of the three-way valve 272 which during a shut down momentarily closes the pipe 270 (at the same time the pump motors 266 are shut down) to prevent further flow of coating material to the applicator. In addition, to relieve the pressure forcing the coating material from the applicator, the valve 272 momentarily connects the pipe 276 to the pipe 274, thus relieving the pressure in the applicator by allowing some coating material to flow into the surge tank 260.

Figure 15:
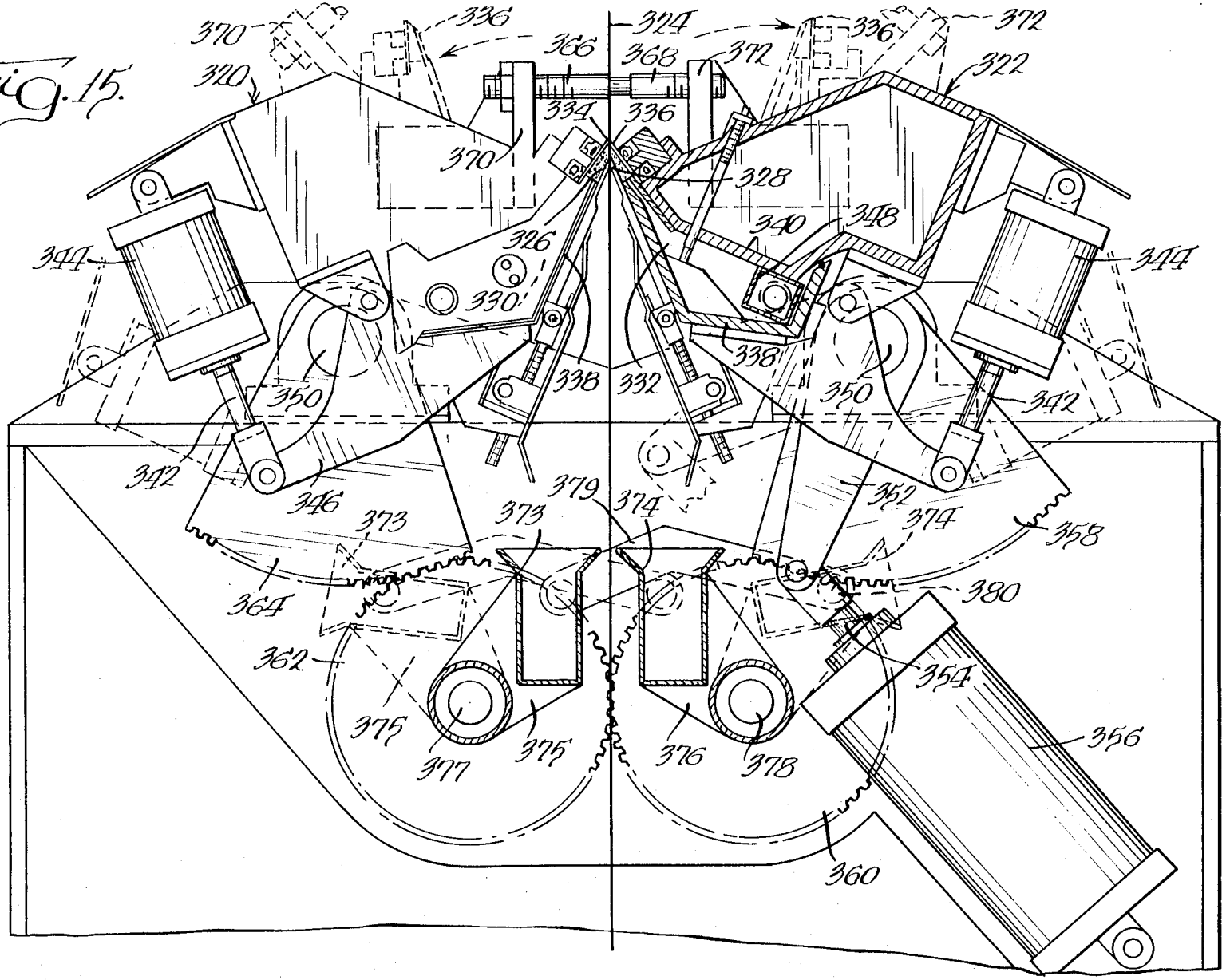
FIG. 15 is a side elevation view, with portions broken away of a fourth embodiment of short dwell time applicator arrangement useable without a backing roll.

Referring to FIG. 15, in a fourth embodiment of the present invention a pair of applicators 320 and 322 are arranged on opposite sides of a web 324. Applicators of the type shown in FIGS. 1 or 9 could have been used, but in this instance, the applicators 320 and 322 are similar to the type shown in FIG. 7. The applicators 320 and 322 are arranged so that they are generally mirror images of one another, with the web disposed between them so that both sides of the web can be coated simultaneously. Of particular advantage is that no backing roll is needed, one of the applicators supporting the web for the other, permitting the pair of applicators to be located on the coating machine in a location where there is no backing roll.

The applicators are positioned such that the web passing through the liquid seals 326 and 328 dnters the pressurized liquid coating chambers 330 and 332 and is wiped by the opposed doctor blades 334 and 336 of the respective applicators 320 and 334. The pressures of the liquid in the chambers 330 and 332 and of the doctor blades 334 and 336 oppose each other and support the web.

Like the applicator 130, each of the applicators 320 and 322 comprise a movable wall 338 and a relatively fixed wall 340 which define the chambers. The movable wall may be pivoted open by retracting the rod 342 into the fluid device or cylinder 344 so that the movable wall pivots on the lever 346. This construction permits access to the internal header 348 and the interiors of the chambers.

Like the other applicators, applicators 320 and 322 may be moved into operating positions (as shown in full lines in FIG. 15) or out of operating positions (as shown in dotted lines in FIG. 15) with the web. The applicators are pivotally mounted to the machine on shafts 350, and an arm 352 on the applicator 322 can cause the applicator 322 to rotate about its shaft 350 when a rod 354 is pulled into a cylinder 356. As the applicator 324 rotates, it causes a quadrant 358 also to rotate, which in turn rotates gear 360, gear 362 and a quadrant 364 secured to the other applicator 320. Thus, both the applicators may be simultaneously moved into or out of their operating positions with the web or to vary the pressure of the blades on the web. The applicators 320 and 322 are held in their operating positions by stop means in the form of adjustable abutting rods 366 and 368 secured to their respective applicators by brackets 370 and 372.

A pair of coating pans 373 and 374 are mounted below the applicators 320 and 322. The pans are pivotally mounted to freely rotate about the shafts 377 and 378 (shafts on which the gears 362 and 360 are mounted) by bracket arms 375 and 376, respectively. The left-hand pan 373 is pivotally connected to an actuating arm 379 which has its other or right-hand end connected to a stub-shaft 380 extending from the gear 360. Though not shown, the pan 374 is similarly connected to the gear 362. Thus, as the gear 360 rotates counter-clockwise upon retraction of applicator 322, the arm 379 causes the pan 373 to rotate counter-clockwise on the shaft 377 to dump the pan away from the web for cleaning. Of course, pan 374 simultaneously dumps in the opposite direction. Thus, the pans 373 and 374 may be simply hosed clean without danger of the cleaning water being discharged from the pans to the surge tank, such as 260, and contaminate the coating supply.

While four embodiments of apparatus of the present invention for practicing the method of the present invention have been described and illustrated, it is to be understood that the invention is not limited thereto, but comprehends other constructions, arrangements of parts and details and other steps and orders for performing the method, without departing from the scope of the invention as set forth in the appended claims. .

What is claimed is:

1. A coating applicator for applying coating liquid to one side of a moving web of paper, comprising means for supporting the moving web in position located on the other side of the web, a beam carrying a front wall and a rear wall forming a chamber extending substantially across and parallel to the web, said chamber having a header with at least one coating liquid inlet and discharging between said front and rear walls, said chamber receiving the coating liquid from said header, said chamber defining a narrow outlet slot extending across the web and adjacent thereto, means for delivering coating liquid through said header, said chamber and said outlet slot and onto said web at a pressure of between 150 and 7 inches of water, a single doctor blade located at a rear edge of said outlet slot on the rear wall of said chamber for doctoring the coating liquid on the web, said doctor blade being spaced from a front edge of said front wall by a small dimension such that the blade doctors the coating liquid on the web within about 0.0004 to about 0.0100 second of the pressure application of the coating to the web, and end dam means for sealing the end spaces between said front and rear walls and said doctor blade with the web, the front edge of said front wall of said chamber being spaced less than one inch from the web, a liquid seal established between said front edge of said front wall and the web continuously across the web at the front edge of said outlet slot by flow of coating liquid under said pressure reversely of the direction of web travel through the space between said front edge of said front wall and the web, said liquid seal causing the coating liquid in said chamber and between said doctor blade and said seal to be held under said pressure while permitting reverse flow of coating liquid between said front edge and the moving web for establishing said liquid seal, for sealing off the forward edge of said chamber against entry of air and foreign matter, for continuously purging said chamber, and for causing said blade to doctor the coating liquid on the web while said coating liquid is held under said pressure, whereby said moving web may be coated with coating applied primarily to the surface of the web and doctored almost immediately so that there is a minimum penetration of coating liquid beyond the surface of the web into the paper; an orifice plate comprising said front edge of said front wall and adjustably mounted on said front wall for movement toward and away from the web for establishing a desired clearance between the front edge of said orifice plate and the web, and means for adjusting said orifice plate to establish a clearance of less than one inch which, in relation to the delivery of coating liquid, is such as to cause a reverse flow of coating liquid under said pressure between said front edge of said orifice plate and the moving web sufficient to maintain said liquid seal and said coating liquid pressure in said chamber; said adjusting means comprising an adjustable member slidable on said front wall in a direction transverse to the movement of said orifice plate and having inclined slots therein, said front wall having vertical slots therein intersecting said inclined slots, said orifice plate carrying first and second cam means engaged respectively in said inclined and vertical slots, the cam means engaging in said inclined slots comprising rotatable rollers eccentrically and adjustably mounted on said orifice plate to provide for uniform engagement thereof within said inclined slots, whereby movement of said adjustable member in a direction transverse to the movement of said orifice plate causes said orifice plate to move linearly toward or away from said web uniformly over its length.

2. A coating applicator for applying coating liquid to one side of a moving web of paper, comprising means for supporting the moving web in position located on the other side of the web, a beam carrying a front wall and a rear wall forming a chamber extending substantially across and parallel to the web, said chamber having a header with at least one coating liquid inlet and discharging between said front and rear walls, said chamber receiving the coating liquid from said header, said chamber defining a narrow outlet slot extending across the web and adjacent thereto, means for delivering coating liquid through said header, said chamber and said outlet slot and onto said web at a pressure of between 150 and 7 inches of water, a single doctor blade located at a rear edge of said outlet slot on the rear wall of said chamber for doctoring the coating liquid on the web, said doctor blade being spaced from a front edge of said front wall by a small dimension such that the blade doctors the coating liquid on the web within about 0.0004 to about 0.0100 second of the pressure application of the coating to the web, and end dam means for sealing the end spaces between said front and rear walls and said doctor blade with the web, the front edge of said front wall of said chamber being spaced less than one inch from the web, a liquid seal established between said front edge of said front wall and the web continuously across the web at the front edge of said outlet slot by flow of coating liquid under said pressure reversely of the direction of web travel through the space between said front edge of said front wall and the web, said liquid seal causing the coating liquid in said chamber and between said doctor blade and said seal to be held under said pressure while permitting reverse flow of coating liquid between said front edge and the moving web for establishing said liquid seal, for sealing off the forward edge of said chamber against entry of air and foreign matter, for continuously purging said chamber, and for causing said blade to doctor the coating liquid on the web while said coating liquid is held under said pressure, whereby said moving web may be coated with coating applied primarily to the surface of the web and doctored almost immediately so that there is a minimum penetration of coating liquid beyond the surface of the web into the paper; a pair of bases, said beam being mounted on said bases, said bases being adapted to be moved to various positions to accommodate use of said applicator with various size backing rolls, each base having an upper portion to which an end of said beam is mounted, and a lower portion adapted to be secured in place, means for moving both of said upper portions relative to said lower portions to adjust said bases for various size backing rolls, an opening in each of said upper portions located so that the axis of said opening is adapted to be tangent to the outer surface of the various size backing rolls and aligned with the doctor blade edge that engages the web, and a locating rod for each opening, each said locating rod having one end adapted to fit axially within the respective opening and having the other end cut-away to the axis of the locating rod whereby said upper portions can be adjusted to their proper positions by moving them toward or away from the backing roll until the cut-away sides of said locating rods lie in the same plane as the adjacent portion of the outer surface of the backing roll.

* * * * *